United States Patent [19]

Kusche et al.

[11] Patent Number: 4,951,733

[45] Date of Patent: Aug. 28, 1990

[54] EVAPORABLE FOAM PATTERN FOR CASTING AN ENGINE BLOCK OF A TWO-CYCLE ENGINE

[75] Inventors: David W. Kusche, Oshkosh; Gordon L. Stiller, Omro; Steven W. Habeck, Oshkosh, all of Wis.

[73] Assignee: Brunswick Corporation, Skokie, Ill.

[21] Appl. No.: 226,122

[22] Filed: Feb. 13, 1989

[51] Int. Cl.[5] ..... B22C 7/02; B22C 9/04

[52] U.S. Cl. ..... 164/246; 164/34; 164/45

[58] Field of Search ..... 164/246, 235, 249, 34, 164/35, 36, 45

[56] References Cited

U.S. PATENT DOCUMENTS

| | | | |
|---|---|---|---|
| 4,632,169 | 12/1986 | Osborn et al. | 164/45 |
| 4,657,063 | 4/1987 | Morris | 164/246 X |
| 4,777,997 | 10/1988 | Corbett | 164/246 |
| • 4,802,447 | 2/1989 | Corbett | 164/45 X |

FOREIGN PATENT DOCUMENTS

| | | | |
|---|---|---|---|
| 62-282744 | 12/1987 | Japan | 164/34 |

*Primary Examiner*—Richard K. Seidel
*Assistant Examiner*—J. Reed Batten, Jr.
*Attorney, Agent, or Firm*—Andrus, Sceales, Starke & Sawall

[57] ABSTRACT

The assembled evaporable pattern, which is substantially identical in shape to the cast metal two-cycle engine block, includes a plurality of in-line cylinders each having an end open to the crankcase end of the pattern. Each cylinder includes an exhaust passage that communicates with an exhaust manifold that extends to the exterior of the pattern and each cylinder has at least one longitudinally extending transfer passage. The assembled pattern also includes cooling passages that surround each cylinder, as well as surrounding the exhaust manifold passage. The foam pattern is composed of a plurality of separate foam sections joined together by an adhesive along planar interfaces. A first of the sections extends from the crankcase end of the pattern to the lower end of the transfer passages, and a second section extends from the lower end of the transfer passages to a location intersecting the exhaust passages of the cylinders. A third section extends from the exhaust passages to the cylinder heads. In addition, a fourth pattern section encloses the water passages at the head end of the block, while a fifth section encloses the water passage that borders the exhaust manifold.

9 Claims, 2 Drawing Sheets

FIG. 1
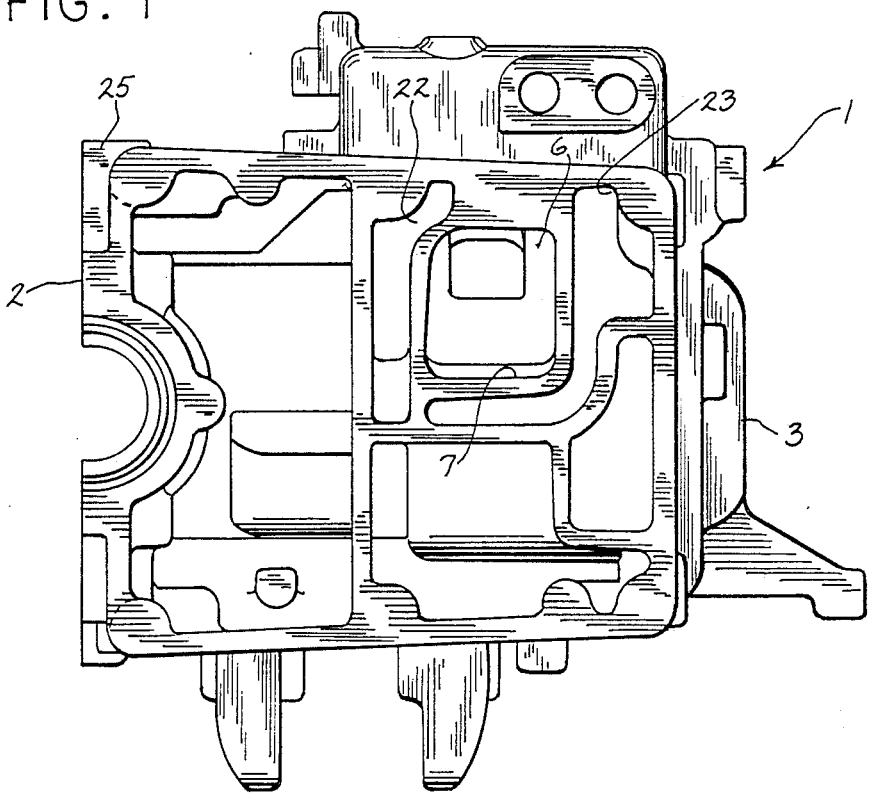
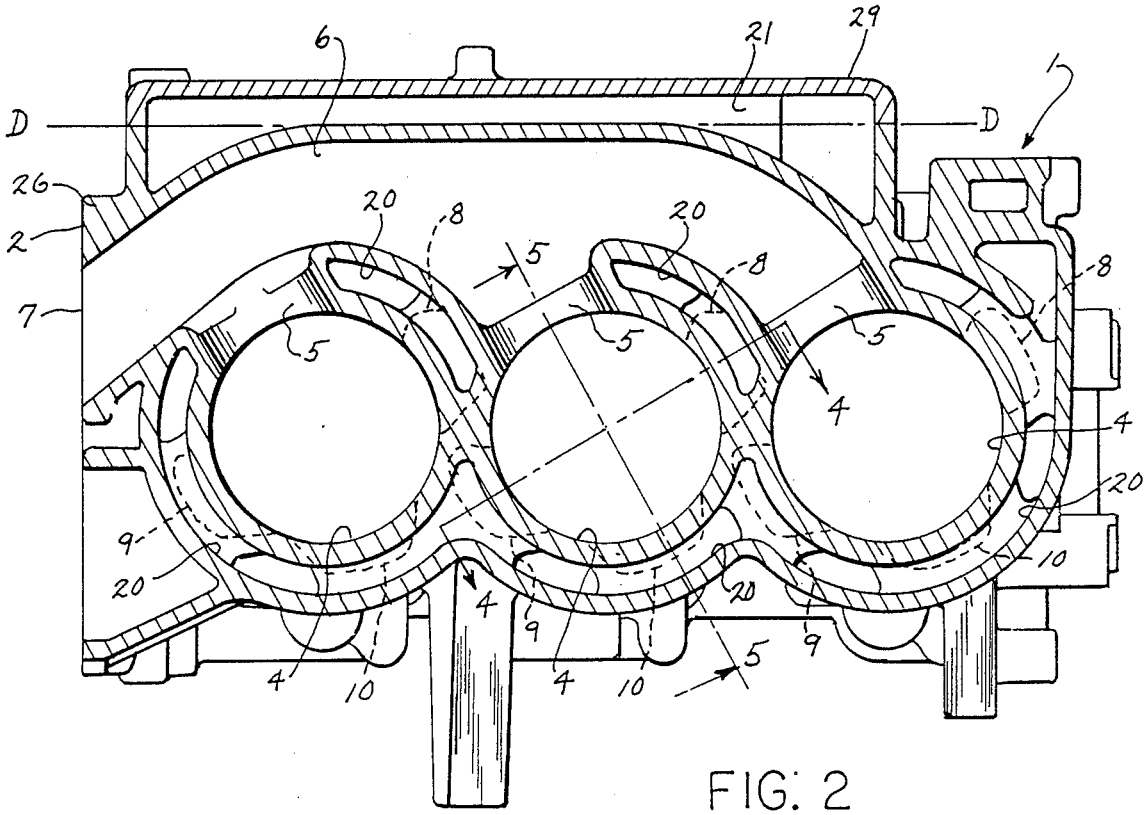
FIG. 2

FIG. 3
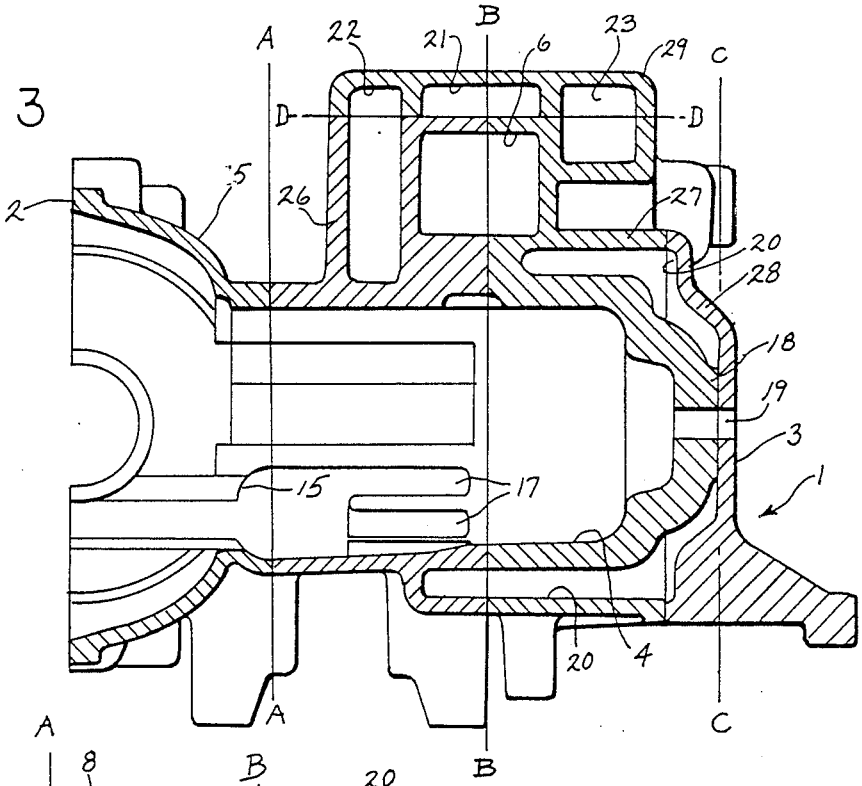
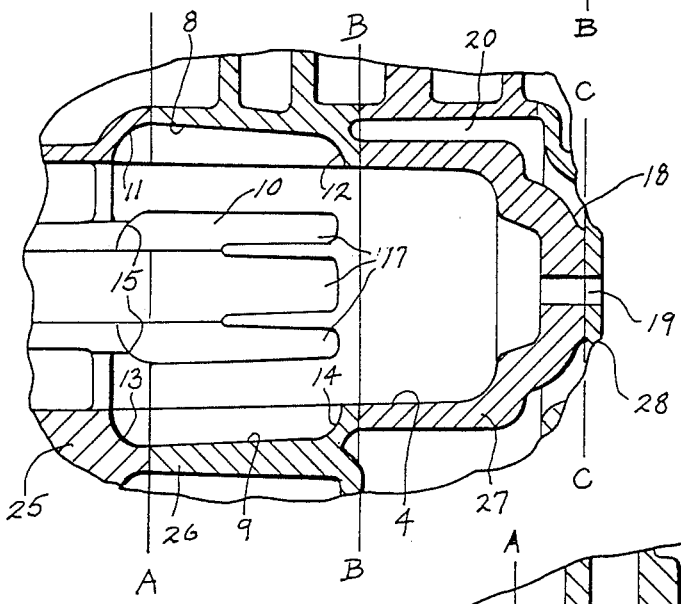
FIG. 4
FIG. 5
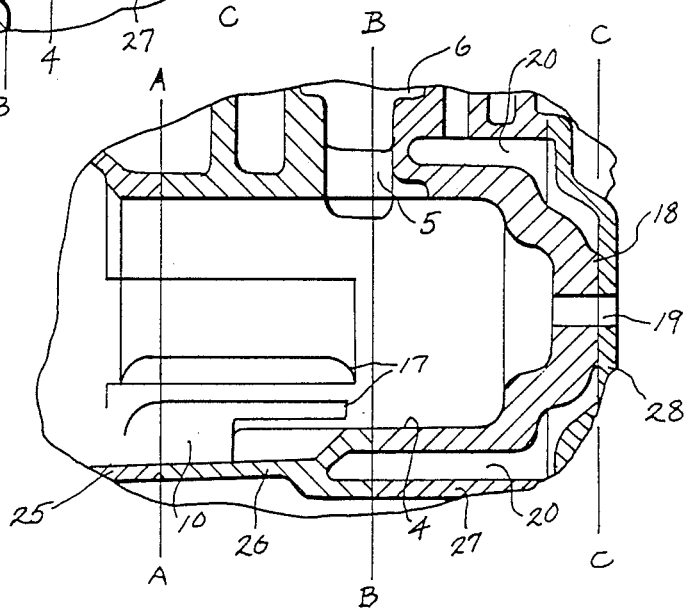

EVAPORABLE FOAM PATTERN FOR CASTING AN ENGINE BLOCK OF A TWO-CYCLE ENGINE

BACKGROUND OF THE INVENTION

Cast metal engine blocks for a multi-cylinder, in-line, two-cycle engine generally consist of a cylinder block and three separate cast covers, including two water passage covers and an exhaust passage cover, all of which are attached to the cylinder block by bolts. To provide the connection between the covers and the cylinder block, the cylinder block is formed with a series of enlarged lands or bosses, which are drilled or cast and tapped to receive bolts, and similarly mating holes are drilled or cast in the covers. In addition, the mating surfaces between the covers and the cylinder block are machined and the covers are attached to the cylinder block through gaskets and bolts. The gasketed surfaces must be provided with a substantial width to receive the gaskets and prevent leakage between the components.

In the fabrication of a conventional three-cylinder, two-cycle engine, as many as 100 fasteners, such as bolts, screws, and the like, are required to attach the covers to the cylinder block and substantial time and labor is required in machining the interfaces, tapping and drilling holes, applying gaskets and bolting the covers to the block. The intensive labor that is required is a substantial factor in the overall cost of the engine.

Furthermore, the requirement for providing bosses on the cylinder block and the increased width of the gasket surfaces adds to the overall weight of the engine.

In evaporable foam casting processes, a pattern is formed of an evaporable foam material, such as polystyrene. The foam pattern is substantially identical in configuration to the cast metal part to be produced, subject to shrinkage and/or other conditions of the casting process. The foam pattern is placed in a mold and surrounded with a finely divided medium, such as sand, which also fills the cavities in the pattern. When molten metal is introduced into the mold, the molten metal will heat and vaporize the pattern, with the vapor passing into the interstices of the sand, while the molten metal will fill the voids created by vaporization of the foam to provide a cast metal part having substantially the same configuration as the foam pattern. Evaporable foam casting processes have particular advantage when casting parts of unusual or complex contours.

SUMMARY OF THE INVENTION

The invention is directed to an evaporable foam pattern to be used in casting a multi-cylinder, in-line, two-cycle engine block. The assembled pattern, which is substantially identical in configuration to the metal engine block to be cast, includes a plurality of in-line cylinders each having an end open to the crankcase end of the pattern. An exhaust passage communicates with each cylinder and the exhaust passages are connected to an exhaust manifold that extends to the exterior of the pattern. In addition, each cylinder has at least one longitudinally extending transfer passage which extends from a location adjacent the crankcase end of the pattern to a position spaced from the head of the cylinder.

The assembled foam pattern also includes a network of water cooling passages which surround the cylinders, as well as the exhaust manifold. Water is introduced into the cooling passages through an inlet passage formed in a side surface of the pattern and is discharged from the cooling passages through a discharge passage located adjacent the inlet passage.

In accordance with the invention, the evaporable foam pattern is formed of a plurality of foam sections which are joined together by glue or adhesive to provide the assembled pattern. More particularly, the pattern includes a first pattern section which extends from the crankcase end of the pattern to the lower ends of the transfer passages, and a second section extends from the lower ends of the transfer passages to a location intersecting the exhaust passages of the cylinders.

A third pattern section extends from the exhaust passages to the heads of the cylinders and a fourth section encloses the outer ends of the cooling passages that surround the cylinders.

The assembled pattern also includes a fifth pattern section that is connected to the second and third pattern sections and includes water passages that border the exhaust manifold passage.

The interfaces or parting lines between the first, second, third and fourth pattern sections are parallel to each other and extend normal to the axes of the cylinders, while the parting line between the fifth section and the second and third sections extends parallel to a plane passing through the axes of the cylinders.

The five separate pattern sections are joined together along the parting lines by a glue or adhesive, such as conventionally used in evaporable foam casting processes, to provide the assembled pattern.

In casting, the pattern is placed in a mold and the region between the pattern and the mold is filled with a flowable material, such as sand, which also fills the cavities in the pattern. Molten metal, such as an aluminum alloy, is introduced to the pattern via a sprue and the heat of the molten metal will vaporize the pattern. The resulting vapor is entrapped within the interstices of the sand, while the molten metal will fill the voids created by vaporization of the foam pattern to provide a cast metal part which is identical in configuration to the pattern.

Through use of the pattern of the invention, the entire engine block can be integrally cast as a single unit, thereby eliminating the machining, drilling and tapping operations that have been practiced in the past when using separate covers and a cylinder block.

As a further advantage, it is not necessary to provide bosses or enlargements on the cylinder block for tapped holes, nor is it necessary to provide wide gasketing surfaces, and this provides an appreciable savings in overall weight of the engine. Elimination of gaskets and covers eliminates a significant source of leakage paths.

As the covers are cast integrally with the cylinder block, the invention eliminates as many as 100 fasteners, i.e. bolts and screws, as previously used in connecting the covers to the cylinder block.

The use of the evaporable foam pattern provides greater design flexibility and enables more uniform wall thicknesses to be obtained, thereby providing more effective heat transfer and reducing the overall weight of the engine.

Other objects and advantages will appear in the course of the following description.

DESCRIPTION OF THE DRAWINGS

The drawings illustrate the best mode presently contemplated of carrying out the invention.

In the drawings:

FIG. 1 is a bottom view cf the evaporable foam pattern used in casting a three-cylinder in-line two-cycle engine;

FIG. 2 is a transverse section of the pattern;

FIG. 3 is a longitudinal section of the pattern;

FIG. 4 is a section taken along line 4—4 of FIG. 2; and

FIG. 5 is a sec ion taken along line 5—5 of FIG. 2.

DESCRIPTION OF THE ILLUSTRATED EMBODIMENT

The drawings illustrate an evaporable foam pattern 1 formed of a material, such as polystyrene, to be used in casting a multi-cylinder, in-line, two-cycle engine block. While the drawings illustrate an engine block having three in-line cylinders, it is contemplated that the invention can be utilized in casting a two-cycle engine block having at least one or more cylinders.

The evaporable foam pattern is substantially identical in shape to the cast metal engine block and, therefore, the description of the components of the foam pattern will correspond to that of the cast engine block.

Pattern 1 includes a crankcase end 2 and a head end 3, and in normal usage of the engine, the crank shaft will extend vertically.

Pattern 1, as assembled, defines three cylinders 4 each having an end that opens at the crankcase end 2 of the pattern. As shown in FIG. 2, an exhaust passage 5 communicates with each cylinder 4 and is located generally mid-way of the length of the cylinder. The exhaust passages 5, in turn, are connected to an exhaust manifold passage 6, as best shown in FIG. 2 and the exhaust manifold passage 6 terminates in an exhaust outlet 7 located in a side of the pattern.

The two-cyle engine also includes three longitudinal transfer passages 8, 9 and 10, which are associated with each of the cylinders 4. As best illustrated in FIG. 4, each transfer passage 8 is provided with a pair of curved or radiused ends 11 and 12, and similarly each transfer passage 9 is provided with curved ends 13 and 14.

Each transfer passage 10 is formed with curved or rounded ends 15 and in addition the end of the transfer passage 10 facing the head of the cylinder is provided with a pair of fingers 17 which divide the passage into three sections, as shown in FIG. 4.

As illustrated in FIGS. 3 and 4, the outer end of each cylinder 4 is enclosed by a dome-shaped head 18 and a hole 19 is formed in the head of each cylinder to receive a spark plug.

Water cooling passages 20 surround the cylinders 4 and a cooling passage 21 also surrounds the exhaust manifold passage 6. Cooling water is introduced to the passages 20 and 21 through a water inlet passage 22 which opens on the side of the block adjacent the exhaust outlet 7, and water is withdrawn from the cooling passages through a water outlet passage 23, which is similarly located adjacent the exhaust outlet 7 in a side of the block.

In accordance with the invention, pattern 1 is composed of five separate evaporable foam sections which are joined together along interfaces or parting lines. More particularly, the pattern 1 includes a crankcase pattern section 25, a central pattern; section 26, a head pattern section 27, a head cover pattern section 28, and a water passage cover section 29.

As best shown in FIG. 3, the crankcase section 25 extends from the crank case end 2 of the pattern to a location at the lower ends of the transfer passages 8, 9 and 10, and is joined to the central section 26 along a parting line or interface A—A. As shown in FIG. 4, the lower ends of transfer passages 8 and 9 are curved or rounded and the parting line A—A is located at the tangent point between the radius of curvature and the longitudinal wall of the transfer passage.

Central section 26 is joined to head section 27 at a parting line or interface B—B, and the parting line B—B, as shown in FIGS. 4 and 5, intersects the cooling water passages 20, as well as the exhaust passages 5. As shown in FIG. 5, the upper end of the exhaust passage 5 is curved or rounded and the parting line is located at the point of tangency of the radius of curvature with the longitudinal wall bordering the exhaust passage.

With this construction, the head 8 of each cylinder is located in the same foam section piece as the upper end of the exhaust passage 5 and, therefore, the critical tolerance between the head 18 and the exhaust passages will be maintained in order to provide the desired flow of combustion products across the head and into the exhaust passage.

The head cover section 28 is joined to the head section 27 along the parting line C—C and the section 28 encloses the cooling passages 20 that surround each of the cylinders 4.

As best shown in FIG. 3, the water passage cover section 29 is joined to the sections 26 and 27 along a parting line D—D and series to close off the water inlet and outlet passages 22 and 23, as well as enclosing the exhaust manifold water cooling passage 21. The parting line D—D is located normal to parting lines A—A, B—B and C—C and is parallel to a plane extending through the axes of the three cylinders 4.

In assembling the pattern 1, the individually cast foam sections 25-29 are attached together along the parting lines by use of a glue or adhesive normally employed in evaporable foam casting processes. The glue is the type that will be vaporized by the heat of the molten metal and the vapor from vaporization of the glue will be trapped in the surrounding sand along with the vapor generated by evaporation of the foam pattern, so that no adhesive residue will be present in the cast metal part.

Through the use of the evaporable foam pattern of the invention, the engine block can be cast as a single integral part, thereby eliminating the machining, drilling and tapping operations that had been used in the past when employing separate covers along with the cast cylinder block. Furthermore, the invention eliminates the need for providing enlarged bosses or lands on the cylinder block that would be subsequently drilled and tapped for attachment of covers and similarly eliminates the need for wide gasketing surfaces. This substantially reduces the overall weight of the engine and the material cost.

In addition, the invention provides greater design flexibility and enables the cylinder walls and exhaust passage walls to have a substantially uniform thickness to obtain better heat transfer, as well as reducing the weight of metal to be utilized.

Various modes of carrying out the invention are contemplated as being within the scope of the following claims particularly pointing out and distinctly claim the subject matter which is regarded as the invention.

We claim:

1. An assembled evaporable foam pattern to be used in casting a two-cycle metal engine block, the assembled pattern comprising a crankcase end and a head end, said pattern including at least one cylinder having an end open to the crankcase end of said pattern and the opposite end enclosed by a head, exhaust passage means connecting said cylinder to the exterior of the patter, said cylinder having at least one longitudinally extending transfer passage, water cooling passage means bordering said cylinder and said exhaust passage means, said pattern composed of a plurality of separate evaporable foam sections including a first section extending from said crankcase end to the corresponding crankcase end of said transfer passage, a second pattern section extending from the crankcase end of said transfer passage to a location intersecting said exhaust passage means, said second section being connected to said first section at a first planar interface located adjacent the crankcase end of said transfer passage, said pattern also including a third section extending from said exhaust passage means to said head end and including said head, said third section being connected to said second section at a second interface intersecting said exhaust passage means, a fourth pattern section disposed at the head end of the pattern and enclosing the portion of said water cooling passage means bordering said cylinder, said fourth section being connected to said third section along a third interface, a fifth pattern section connected to the corresponding sides of said second and third sections along a fourth interface and enclosing the side of said water cooling passage means bordering said exhaust passage means, and adhesive means disposed at said interfaces for joining the respective sections together.

2. The pattern of claim 1, wherein said exhaust passage means includes an exhaust port communicating with said cylinder, the upper end of said exhaust port and the head of the cylinder being located in said third section.

3. The pattern of claim 1, wherein said transfer passage is bordered by a longitudinal wall and the end of the transfer passage facing said crankcase end is curved along a radius, said first interface is located at the point of tangency of said radius to the longitudinal wall.

4. The pattern of claim 1, wherein said exhaust passage means is bordered by a longitudinal wall and the end of the exhaust passage means facing said head is curved on a radius, said second interface is disposed at the point of tangency of said radius to said longitudinal wall.

5. The pattern of claim 1, wherein the end of said transfer passage facing said head end is disposed in said second pattern section and is spaced from said second interface.

6. The pattern of claim 1, wherein said water cooling passage means includes a generally annular passage spaced radially outward of said cylinder and disposed in said third section, the end of said annular passage facing said head end of the pattern being open, said fourth section enclosing the open end of said annular passage.

7. In an assembled evaporable foam pattern to be used in casting a two-cycle metal engine block, the assembled pattern comprising a crankcase end and a head end, at least one cylinder having an end open to the crankcase end of said pattern and an opposite end enclosed by ahead, at least one longitudinally extending transfer passage having an entry end communicating with the crankcase end of the cylinder and having a discharge end communicating with the head end of said cylinder, said pattern including a first evaporable foam section extending to said crankcase end of the pattern and further including a second evaporable foam pattern section joined to said first section at an interface disposed adjacent said entry end, said interface disposed generally normal to the axis of the cylinder, and adhesive means disposed at said interface for joining the sections together.

8. The pattern of claim 7, wherein said entry end has a greater cross-sectional area than said discharge end.

9. The pattern of claim 8, wherein said transfer passage is bordered by a longitudinal wall and the entry end of the transfer passage is curved along a radius, said interface being located at the point of tangency of said radius to the longitudinal wall.

* * * * *

UNITED STATES PATENT AND TRADEMARK OFFICE

CERTIFICATE OF CORRECTION

PATENT NO. : 4,951,733

DATED : August 28, 1990

INVENTOR(S) : DAVID W. KUSCHE ET AL

It is certified that error appears in the above-identified patent and that said Letters Patent is hereby corrected as shown below:

Col. 5, Line 4, CLAIM 1, Cancel "patter" and substitute therefor --pattern--; Col. 6, line 22, CLAIM 7, Cancel "ahead" and substitute therefor --a head--

Signed and Sealed this

Twenty-first Day of April, 1992

*Attest:*

HARRY F. MANBECK, JR.

*Attesting Officer*

*Commissioner of Patents and Trademarks*